US009702612B2

(12) United States Patent
Köfele

(10) Patent No.: US 9,702,612 B2
(45) Date of Patent: Jul. 11, 2017

(54) COOLING AND/OR FREEZING DEVICE

(71) Applicant: LIEBHERR-HAUSGERÄTE LIENZ GMBH, Lienz (AT)

(72) Inventor: Markus Köfele, Hopfgarten (AT)

(73) Assignee: LIEBHERR-HAUSGERÄTE LIENZ GMBH, Lienz (AT)

( * ) Notice: Subject to any disclaimer, the term of this patent is extended or adjusted under 35 U.S.C. 154(b) by 0 days.

(21) Appl. No.: 14/896,978

(22) PCT Filed: Jun. 12, 2014

(86) PCT No.: PCT/EP2014/001604
§ 371 (c)(1),
(2) Date: Dec. 9, 2015

(87) PCT Pub. No.: WO2014/198417
PCT Pub. Date: Dec. 18, 2014

(65) Prior Publication Data

US 2016/0123653 A1 May 5, 2016

(30) Foreign Application Priority Data

Jun. 13, 2013 (DE) ..... 10 2013 009 937

(51) Int. Cl.
*A47B 96/04* (2006.01)
*F25D 23/02* (2006.01)
(Continued)

(52) U.S. Cl.
CPC ..... *F25D 23/028* (2013.01); *F25D 17/04* (2013.01); *F25D 23/062* (2013.01);
(Continued)

(58) Field of Classification Search
CPC ..... F25D 17/04; F25D 29/005; F25D 23/028; F25D 23/062; F25D 2400/36; F25D 2400/40
See application file for complete search history.

(56) References Cited

U.S. PATENT DOCUMENTS 3,895,198 A 7/1975 Piber
5,847,343 A 12/1998 Kim
(Continued)

FOREIGN PATENT DOCUMENTS

DE 198 04 896 A1 8/1999
DE 20 2006 013 233 U1 11/2006

OTHER PUBLICATIONS

International Search Report dated Sep. 1, 2014, issued in counterpart International Application No. PCT/EP2014/001604, w/ English translation (4 pages).

*Primary Examiner* — Hanh V Tran
(74) *Attorney, Agent, or Firm* — Westerman, Hattori, Daniels & Adrian, LLP

(57) ABSTRACT

A refrigerator unit and/or freezer unit is disclosed having at least one carcass in which a cooled inner space is arranged and having at least one closure element by which the cooled inner space can be closed. The carcass has one or more contact elements at the carcass side and the closure element has one or more contact elements at the closure element side, wherein at least one switch is provided which allows a current flow through the contact elements in the closed state and prevents a current flow through the contact elements in the open state, wherein the switch is switched from its open state into its closed state upon reaching of a specific closing angle, and the switch is switched into the closed state as soon as or after the contact elements at the closure element side are in contact with the contact elements at the carcass side.

8 Claims, 2 Drawing Sheets

Figure 1:
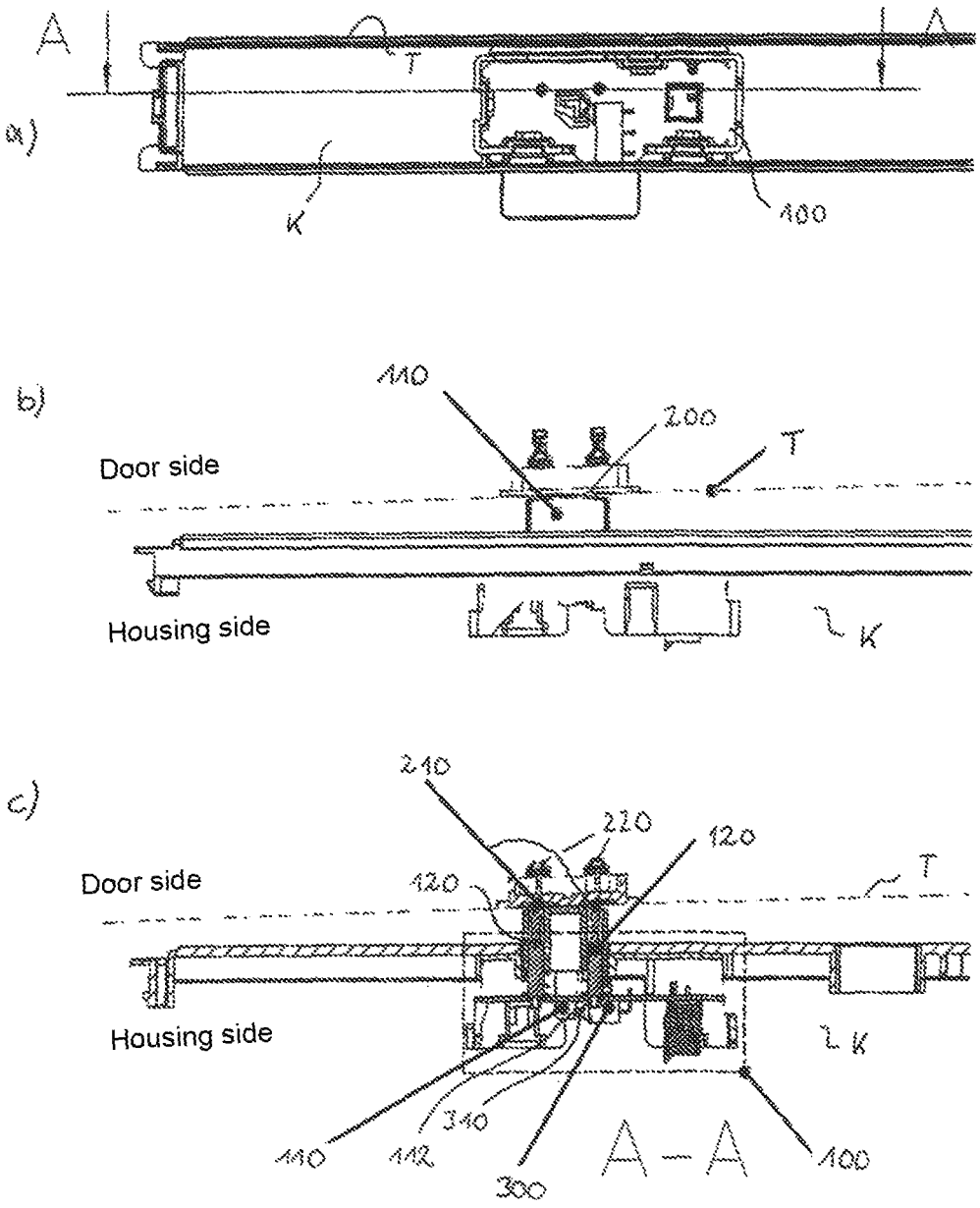

(51) Int. Cl.
*F25D 29/00* (2006.01)
*F25D 17/04* (2006.01)
*F25D 23/06* (2006.01)

(52) U.S. Cl.
CPC ..... *F25D 29/005* (2013.01); *F25D 2400/36* (2013.01); *F25D 2400/40* (2013.01); *F25D 2700/02* (2013.01)

(56) References Cited

U.S. PATENT DOCUMENTS

| | | | | |
|---|---|---|---|---|
| 9,053,877 | B2 * | 6/2015 | Young | H01H 13/14 |
| 2009/0320509 | A1 * | 12/2009 | Gorz | F25D 21/04 62/264 |
| 2010/0014993 | A1 * | 1/2010 | Wang | A47C 27/082 417/315 |
| 2010/0032270 | A1 * | 2/2010 | Spiessl | H01H 13/183 200/290 |
| 2011/0214970 | A1 * | 9/2011 | De France | H01H 1/26 200/274 |
| 2012/0132510 | A1 * | 5/2012 | Salagean | H01H 25/002 200/573 |

* cited by examiner

COOLING AND/OR FREEZING DEVICE

The present invention relates to a refrigerator unit and/or freezer unit having at least one carcass in which at least one cooled inner space is arranged and having at least one closure element, in particular at least one door, by means of which the cooled inner space can be closed, wherein the carcass has one or more contact elements at the carcass side and the closure element has one or more contact elements at the closure element side for the power transfer from the carcass into the closure element.

Refrigerator units and/or freezer units are known from the prior art which have a display in the door which is supplied from a power source arranged at the carcass side. The power supply can in this respect take place via cables which are guided via hinges or supports of the door, which brings about the disadvantage, however, that in most cases higher construction space dimensions are required which are frequently not available.

It is thus the object of the present invention to further develop a refrigerator unit and/or freezer unit of the initially named kind such that no higher construction space dimension is required for the power supply of the door.

This object is achieved by a refrigerator unit and/or freezer unit having the features of claim 1. Provision is accordingly made that the refrigerator unit and/or freezer unit has at least one switch which allows a current flow from the contact element at the carcass side to the contact element at the closure element side in the closed state and prevents such a current flow in the open state, wherein the switch is arranged, on the one hand, such that it is switched from its open state into its closed state on reaching a specific switching angle of the closure element, in particular of the door. On the other hand, the switch is arranged such that it is only switched into the closed state at that time or after that time at which the contact elements at the closure element side are in contact with the contact element at the carcass side.

Provision is thus made in accordance with the invention that a respective one or more contact elements, preferably a respective two contact elements, are provided both at the closure element and at the carcass which come into contact with one another on reaching a specific closing angle so that the closure elements at the door side are in electrical contact with the closure elements at the carcass side. A switch is furthermore provided which allows or prevents a current flow over the contact elements depending on its state. This switch is arranged such that it is only closed after the establishing of a contact of the contact elements so that the contacting of the contact elements takes place first and the closing of the switch and thus the possibility of a current flow is only present at this time or thereafter.

The advantage of this arrangement is inter alia that higher construction space dimensions are not required and in particular that no permanently live contact elements such as pins are present. The energy supply or the current flow only takes place in the course of the closing process of the closure element and indeed at the earliest when the individual contact elements are already touching. A spark formation and the wear or melting of contact surfaces which result therefrom are avoided due to the open state of the switch before the contacting of the contact elements. A "sticking" of the contact elements can thus also not take place.

As stated, the release of the energy supply with a delay is implemented using a switch which is actuated in a suitable manner.

It is conceivable that the switch is arranged such that it is only switched into its closed state on reaching the closed position of the closure element. In this case, an energy transfer via the contact elements is only possible when the closure element, e.g. the door, is completely closed.

Provision is made in a further embodiment of the invention that at least one switch cam is provided for actuating the switch.

This switch cam can be arranged, for example, at or in the carcass of the unit and can be pushable into or extendable out of it.

The switch itself can have at least one movably arranged element such as a spring-loaded bolt, wherein this element is configured, for example, such that it closes the switch on the moving into the switch and opens the switch when moving out of the switch. This movably arranged pin is actuated or moved, for example, by a switch cam which is in turn withdrawn or pushed out depending on whether the door or another closure element is closed or open.

Provision is thus made in a preferred embodiment of the invention that the switch cam is arranged movable and cooperates with the movably arranged element of the switch.

It is furthermore conceivable that the switch cam has a slot-like surface so that the movably arranged element of the switch is pressed in or is in the pushed out state depending on the position of the switch cam.

The switch cam is preferably arranged at the carcass side. It is preferably spring-loaded and is acted on by a force which moves the switch cam into its extended position.

The switch can also be arranged at the carcass side. Other embodiments of the invention are generally also covered, namely that the switch cam and/or the switch is/are not arranged in the carcass, but rather in or at the closure element.

It is important that the switch is arranged such that a current flow over the contact elements can only take place on or after the connection of the two sides (at the carcass side and at the closure element side), i.e. from a specific closing angle of the closure element onward, and an energy transmission via the contact elements is prevented due to the open switch before reaching this closed angle.

The switch cam can be movable in a direction, for example, which extends perpendicular or obliquely to the plane formed by the front side of the carcass.

Provision is made in a further embodiment of the invention that at least one contact surface is arranged at the closure element in which contact surface the contact elements at the closure element side extend and preferably terminate therein and which cooperates with the switch cam at least in the closed position of the closure element.

It is achieved by the present invention that a current flow or an energy transfer is only possible via the contact elements when these contact elements are in contact with or come into contact with the respective counterpiece (at the carcass side or at the closure element side). An energy supply is prevented by the open switch before the coming into contact of the contact elements at both sides.

Figure 2:
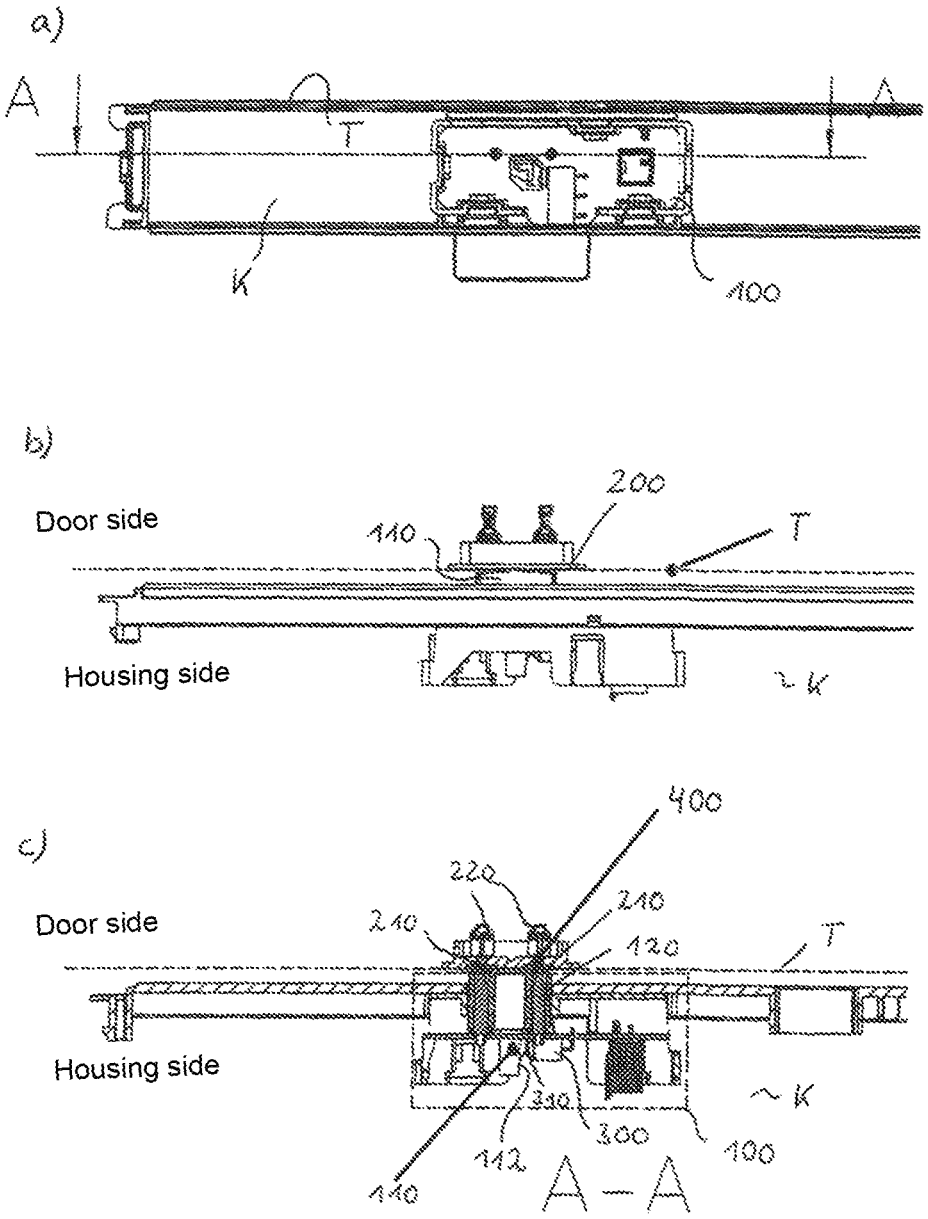

Further details and advantages of the invention will be explained with reference to an embodiment shown in the drawings. There are shown:

FIG. 1: different views of the upper or lower end regions of the carcass and of the door with a slightly open door; and FIG. 2: different views of the upper or lower end regions of the carcass and of the door with a completely closed door.

A plan view of the upper end region of the housing or of the carcass is shown in FIG. 1*a*. A transverse connection can be located in this upper end region.

The contact unit 100 is arranged at the carcass side in this upper end region. As can be seen from the plan view in accordance with FIG. 1*b*, the contact unit 100 extends from the front side of the carcass or from the front side of the transverse connection to the rear, i.e. into the carcass, and has the required switch elements which are needed for interrupting and for releasing a current flow via the contact elements.

In the Figures, the carcass or the carcass side of the unit is marked by the reference symbol K and the door or the door side by the reference symbol T.

As can furthermore be seen from FIG. 1*b*, a switch cam 110 extends from the front side of the carcass and is pressed into the carcass by a contact surface 200 of the door T during the closing procedure of the door T, i.e. it is displaced in the direction of the carcass K.

It can be seen from the sectional view (in accordance with the line A-A in FIG. 1*a*) in accordance with FIG. 1*c* that two contact surfaces 210, i.e. the ends of the contact elements 220 at the door side, are arranged in the door T. Cables extend via the contact elements 220 at the door side to a power consumer, not shown, at the door side such as a display, ice-maker, etc.

The contact surfaces 210 in the position of the door T shown in FIG. 1 are still slightly spaced apart from the two contact elements 120 arranged at the carcass side.

The switch cam is also marked by the reference numeral 110 in FIG. 1*c*. The contact pins 120 at the carcass side can be pushed together and moved apart in the manner of a telescope. They can be spring loaded such that they are in the extended state in the open state of the door T.

The pushing of the switch cam 110 into the carcass takes place by laying the switch cam at the contact surface 200 at the door side in the course of the closing procedure of the door T taking place starting from FIG. 1.

In this respect, the contact pins 120 at the carcass side are also pushed together until they are finally in electrically conductive contact with the contact surfaces 210 of the door.

A switch, for example a miniature switch, which is actuated using the integrated switch cam 110 is marked by the reference numeral 300. The miniature switch 300 has a make contact which is actuated using a movably arranged and spring-loaded pin 310.

In its end region facing the switch 300, the switch cam 110 has a slot-like surface 112 which is connected to the end region of the pin 310.

In the position shown in FIG. 1*c*, the end surface of the pin 310 is in a recess of the slot 112 so that the pin 310 is not pressed into the switch 300 and the switch 300 is thus open. A current flow over the contact elements 120, 220 is prevented in this state since the switch is open.

A spark formation between the contact elements 210 and 120 and the wear which results from this, including the melting of the contact surfaces, is avoided in this manner since a current flow is not possible.

If the door is closed further starting from the state in accordance with FIG. 1 and is moved fully into its closed position, the positions in accordance with FIG. 2 are reached.

Identical elements are provided with the same reference numerals in FIG. 2 as in FIG. 1. The views in accordance with FIGS. 2*a* to 2*c* correspond to those in accordance with FIGS. 1*a* to 1*c* with the difference that the door T is completely closed in FIGS. 2*a* to 2*c*.

It in particular results from the sectional view in accordance with the line A-A in FIG. 2*a*, i.e. from FIG. 2*c*, that a contact takes place between the surfaces 210 and the pins 120 at the point marked by the reference numeral 400 so that a current flow can take place there.

This is possible since the switch 300 is now closed. The closing of the switch 300 has taken place in that—as can be seen from FIG. 2*c*—the switch cam 110 was moved further into the carcass so that the end region of the pin 310 is now no longer in contact with the shown recess of the slot 112, but rather with a further projecting outer surface of the switch cam and is thus pressed into the switch 300. The switch is thereby closed and a current flow over the contact elements 210, 120 is possible.

The present invention is naturally not restricted to doors as closure elements, but rather covers any desired closure element such as also shutters, flaps, etc.

It is ensured due to the fact that the energy transfer only takes place during the closing procedure or only when the contact pins at the carcass side already contact the contact surfaces at the door that a spark formation and the wear resulting therefrom do not occur.

The invention claimed is:

1. A refrigerator unit and/or freezer unit, comprising:

at least one carcass in which at least one cooled inner space is arranged, the carcass including at least one contact element on a carcass side, at least one closure element, by means of which the cooled inner space can be closed, the closure element including at least one contact element on a closure element side, such that electrical power is transferable from the contact element on the carcass side to the contact element on the closure element side, and at least one switch which allows a current flow through the contact element on the carcass side and the contact element on the closure element side in the closed state and prevents a current flow through the contact element on the carcass side and the contact element on the closure element side in the open state, wherein the switch is switched from an open state into a closed state on a reaching of a specific closing angle of the closure element, wherein the switch is switched into the closed state as soon as or after the contact element on the closure element side is in contact with the contact element on the carcass side, wherein the switch comprises at least one switch cam to actuate the switch, wherein the switch comprises at least one movably arranged element which is configured to close the switch upon moving into the switch and open the switch upon moving out of the switch, and wherein the switch cam is movable and cooperates with the movably arranged element of the switch.

2. A refrigerator unit and/or freezer unit in accordance with claim 1, wherein the switch is only switched into the closed state upon reaching the closed state of the closure element.

3. A refrigerator unit and/or freezer unit in accordance with claim 1, wherein the movably arranged element is a pin.

4. A refrigerator unit and/or freezer unit in accordance with claim 1, wherein the switch cam either (i) a slot-like surface, (ii) is disposed on the carcasses side, or (iii) has a slot-like surface and is disposed on the carcass side.

5. A refrigerator unit and/or freezer unit in accordance with claim 1, wherein the switch is disposed on the carcass side.

6. A refrigerator unit and/or freezer unit in accordance with claim 1, wherein the switch cam is movable in a direction which extends perpendicular to or obliquely to a plane formed by a front side of the carcass.

7. A refrigerator unit and/or freezer unit in accordance with claim 1, wherein the contact element on the carcass side includes a first end which contacts the contact element on the closure element side at least in the closed position of the closure element and a second end which cooperates with the switch cam at least in the closed position of the closure element.

8. A refrigerator unit and/or freezer unit in accordance with claim 3, wherein the pin is a spring-loaded pin.

* * * * *